United States Patent [19]

Watanabe

[11] Patent Number: 4,765,380

[45] Date of Patent: Aug. 23, 1988

[54] DRIVE ROLLER ASSEMBLY OF VENEER LATHE FOR ROTATING LOG AND VENEER LATHE

[75] Inventor: Kenzō Watanabe, Ohbu, Japan

[73] Assignee: Meinan Machinery Works, Inc., Aichi, Japan

[21] Appl. No.: 23,944

[22] Filed: Mar. 10, 1987

[30] Foreign Application Priority Data

Mar. 24, 1986 [JP] Japan ..... 61-064165

[51] Int. Cl.[4] ..... B27L 5/02

[52] U.S. Cl. ..... 144/213; 144/365

[58] Field of Search ..... 144/209 R, 211, 212, 144/213, 365

[56] References Cited

U.S. PATENT DOCUMENTS 4,262,716 4/1981 Hasegawa ..... 144/209 R 4,269,243 3/1981 Hasegawa ..... 144/209 R

FOREIGN PATENT DOCUMENTS 59-28163 11/1984 Japan .

59-162011 12/1984 Japan .

*Primary Examiner*—W. Donald Bray

*Attorney, Agent, or Firm*—Lowe, Price, LeBlanc, Becker & Shur

[57] ABSTRACT

A roller assembly of a veneer lathe for rotating a log is disclosed. It comprises a rotatable element, an elastic element provided on the rotatable element, and a plurality of ring shaped members each having a periphery for being urgedly contacted the periphery of a log. The ring shaped members are spacedly provided on the rotatable element with the elastic element interposed therebetween. A veneer lathe including the above-mentioned roller assembly is also disclosed.

11 Claims, 5 Drawing Sheets

DRIVE ROLLER ASSEMBLY OF VENEER LATHE FOR ROTATING LOG AND VENEER LATHE

BACKGROUND OF THE INVENTION

This invention relates to a drive roller assembly of a veneer lathe for rotating a log, in which the drive roller assembly is formed on its outer periphery with a ring shaped member and adapted to be urgedly contacted at the outer periphery thereof with log to rotate the same. From another aspect, the invention relates to a veneer lathe including such drive roller assembly as above mentioned.

A drive roller assembly urgedly contacting the outer periphery of a log and rotating the same is disclosed in Japanese patent early laid-open publication No. 59-162011, in which metal pieces arranged on an abutting face of the roller assembly abuttable against the log are attached with an elastic ring, such as urethane rubber integrally molded with resin, to increase the coefficient of friction with respect to the outer periphery of the log and release the frictional heat.

Although this conventional device has such advantage as that no extraordinary large force is generated by virtue of elastic deformation of the elastic ring even when foreign matters such as cutting chips of the log enters between the log and the roller assembly during the cutting operation of the log, it has the shortcoming in that when a large force is applied to metal pieces each of which is buried and held in the elastic ring in the rotating direction of the roller assembly, the elastic ring, particularly the portion in which the metal piece is buried, is broken to permit the metal piece to come off, which makes it difficult to cut a log of the kind having a large cutting resistance and a thick veneer sheet.

Another device is disclosed in Japanese Patent publication No. 59-28163, which is especially intended to rotate a log of the type having a generally even periphery. This device has the shortcoming in that when foreign matter enters between the log and the roller assembly for rotating the log, an extraordinary force generated against the log and the roller assembly causes such problems as the log cracking, the chuck and the log slipping relative each other and breakage of the roller assembly.

The present invention eliminates the above-mentioned shortcomings inherent in the prior art.

SUMMARY OF THE INVENTION

It is therefore an object of the present invention to provide a roller assembly of a veneer lathe for rotating a log, wherein means is provided to prevent a log and a roller assembly for rotating the log from being directly subjected an extraordinary force when foreign matter enters between the log and roller assembly.

Another object of the invention is to provide a roller assembly of a veneer lathe for rotating a log, wherein a log is not cracked nor is broken a roller assembly when foreign matter enters between the log and roller assembly.

A further object of the invention is to provide a roller assembly of a veneer lathe for rotating a log, which is provided on its periphery with a plurality of spikes and yet is capable of cutting a log having a large diameter into a veneer sheet having no cracks even when the log becomes smaller in diameter during the cutting operation.

A still further object of the invention to provide a veneer lathe which includes the above mentioned roller assembly of a veneer lathe for rotating a log.

In order to achieve the above objects, in one aspect of the present invention, there is essentially provided a roller assembly of a veneer lathe for rotating a log comprising rotatable means, elastic means provided on the rotatable means, and a plurality of ring shaped members each having a periphery for urgedly contacting the periphery of a log to rotate the log, the ring shaped members being spaced on the rotatable means with the elastic means interposed therebetween.

To another aspect of the invention, there is essentially provided a veneer lathe including a roller assembly comprising rotatable means, elastic means provided on the rotatable means, a plurality of ring shaped members each having on its periphery a plurality of spikes and spacedly provided on the rotatable means with the elastic means interposed therebetween, the roller assembly being provided in parallel relation with a log cutting knife at position where the roller assembly contacts a log and a veneer sheet immediately after the veneer sheet is cut, and a pressure member disposed between adjacent ring shaped members to press the log slightly ahead of the knife.

As for the ring shaped member, there is usually employed a member having spikes on its entire periphery so as to rotate a log effectively when urgedly contacting the outer periphery of the log. However, a member having an even and smooth periphery may be employed if a veneer sheet having no spiking trace is required.

As for material of the ring shaped member, stainless steel may be employed to avoid rust. Alternatively, an integrally molded plastic may be employed. An important feature is that the ring shaped member is formed thick enough so as not to be deformed but to keep a round shape when an external force is applied thereto.

As for the elastic means, urethane rubber may be employed. Alternatively, raw rubber may be employed. Further, a fiber-like material as a reinforcing material may be mixed with such urethane rubber or raw rubber and the obtained mixture is integrally molded into a desired elastic means. The elastic means is preferably approximately 20 to 60 in JISA hardness and most preferably approximately 40.

BRIEF DESCRIPTION OF THE DRAWINGS

The several features and advantages of the present invention will become more apparent to those skilled in the art by reference to the detailed description which follows taken in conjunction with the several figures of the drawing in which.

DETAILED DESCRIPTION OF THE EMBODIMENTS

Figure 1:
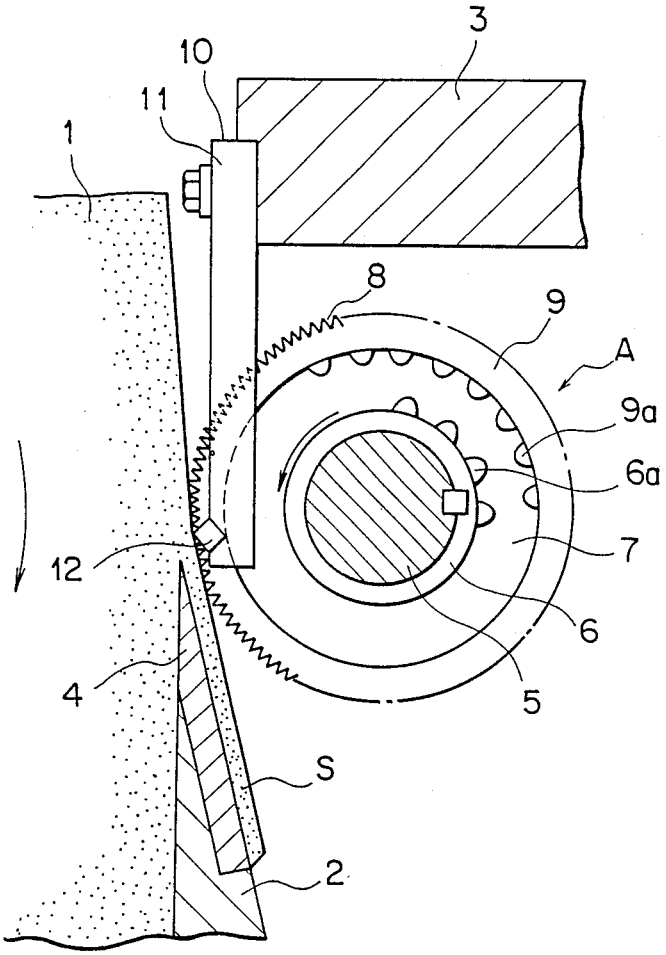
FIG. 1 is a side view of one embodiment of the present invention.
Figure 2:
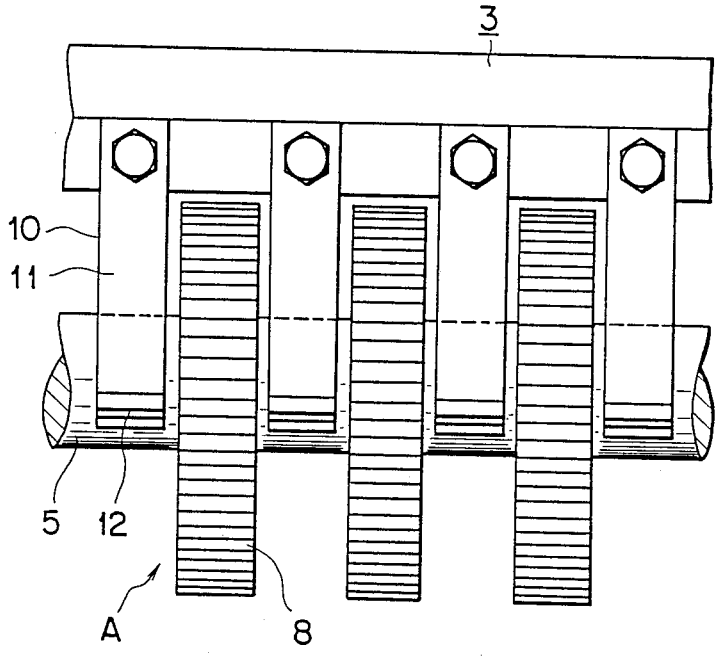
FIG. 2 is a front view showing a part of FIG. 1.

Referring first to FIGS. 1 and 2, one preferred embodiment of the present invention will be described. In the figures, a tool table or knife table 2 and a supporting frame 3 are integrally formed with each other and which are caused to gradually advance toward a log 1 which is rotatably supported by a spindle (not shown).

The knife table 2 is mounted with a tool or knife 4 having a cutting edge parallel with the axial line of the spindle and adapted to cut out a veneer sheet S from the log 1.

The supporting frame 3 is provided with a plurality of roller assemblies A for rotating a log as will be described, which are spacedly arranged at positions slightly ahead of the cutting edge of the knife where the peripheries of the roller assemblies A contact both the peripheries of the log 1 and veneer sheet S and in parallel relation with the cutting edge of the knife 4.

A urethane rubber 7 having a ring shape is fixed on the periphery of a stationary ring 6 which is stationarily mounted on a rotatable shaft 5 rotated by a motor (not shown) by inserting keys into a key groove at desired spaces. The rotatable shaft 5 and stationary ring 6 constitute rotatable means. On the periphery of the urethane rubber 7, a ring-shaped member 9 made of a steel material and having a projecting portion 8 comprising a plurality of spikes is fixed.

Figure 7:
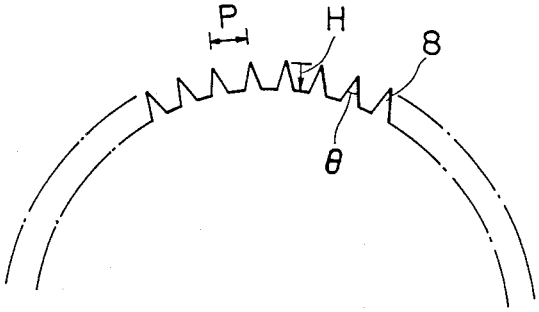
FIG. 7 is an illustration for explaining, in detail, the structures of spike members formed on the drive roller assembly of the present invention.

The projecting portion 8 is formed by using a ring shaped member having, for example, the diameter of 135 mm and the width of 10 mm and arranging thereon a plurality of spikes, as shown in FIG. 7, having the top angle $\theta$ of 30 degrees, height H of 2 mm and pitch P of 3 mm in the axial direction. Where necessary, the central portion widthwise of the projecting portion 8 may be cut out allowing the remaining both sides to project.

On the other hand, between adjacent rollers A (rollers constitute a roller assembly but the latter will also be referred to as a roller or rollers hereinafter) arranged at desired spaces, a pressure bar 10 is disposed so as to press contact the log 1 slightly ahead of the cutting edge of the knife 4. The pressure bar 10 comprises a holder 11 fixed to the supporting frame 3, and an exchangeable tip 12 mounted on the front end of the holder 11 and adapted to urgedly contact the log.

Operation of the above embodiment will be described.

With the above-described construction, the log 1 is rotated by a spindle and the roller A, while the knife table 2 and the supporting frame 3 are advanced toward the log 1.

Then, the log 1 is cut by the knife 4 to produce a veneer sheet discharged through a space between the knife 4 and the pressure bar 10.

In such cutting operation as mentioned, when a log of the kind having a large cutting resistance and a thick veneer sheet are cut, a large force is often incurred to the ring shaped members 9. However, since the ring shaped members 9 are fixed at the entire rear surfaces with the urethane rubber 7, the areas of the ring shaped members 9 held on the urethane rubber 7 are vast which means the holding power is also large. Accordingly, the ring shaped members 9 do not easily come off from the urethane rubber 7.

If the ring shaped member 9, as shown in FIG. 1, is formed at its inner side with a projecting portion 9*a* and thereafter integrally molded with the urethane rubber, the holding power becomes larger. Similarly, the stationary ring 6 may be formed with a projecting portion 6*a* in order to obtain a preferable stationary relation between the stationary ring 6 and the urethane rubber 7.

Figure 8:
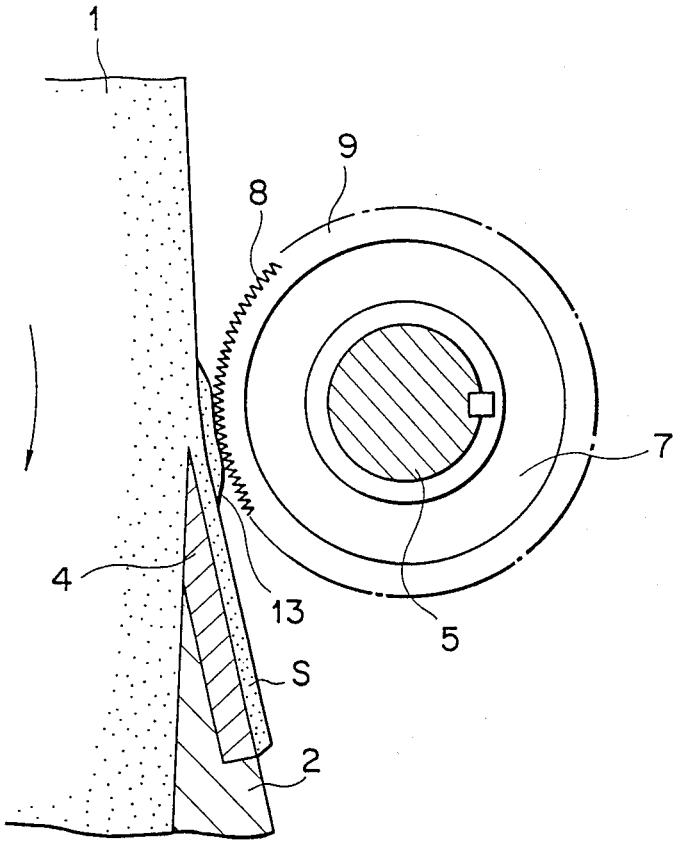
FIG. 8 is an illustration for explaining one state of the drive roller assembly of the present invention will foreign matters entered.

Furthermore, even when foreign matter 13, as shown in FIG. 8, enters between the log and the roller A during the cutting stage, a portion of the urethane rubber 7 corresponding to the foreign matter 13 is compressed and deformed at the log 1 side. This means that the ring shaped member 9 is moved and displaced in the direction opposite the log and with respect to the rotatable shaft 5. Accordingly, an extraordinary large force is not incurred to the log 1 and roller A.

If a projecting portion is provided on the periphery of a roller having a rigid body caused to be rotated as in the case of the veneer lathe described in Japanese Patent publication No. 56-16729, there involves the following problem.

Figure 4:
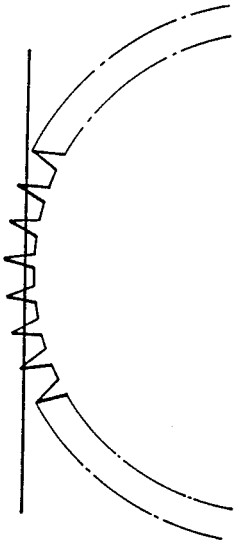
FIGS. 4, 5 and 6 are schematic views for comparing and explaining the functions of the conventional drive roller assembly and that of the present invention.
Figure 5:
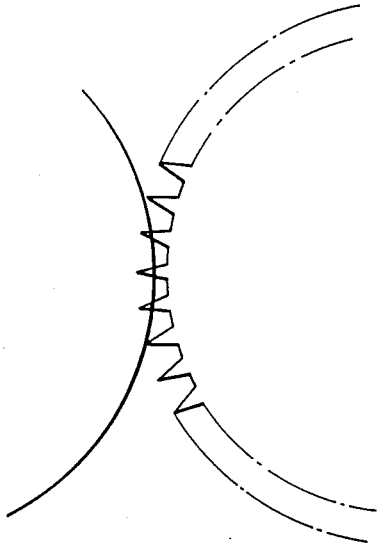

That is, when the log is large enough in diameter, a sufficient number of spikes for rotating the log are abutted against the log as shown in FIG. 4, but when the log was cut and became smaller in diameter, the number of the spikes are decreased as shown in FIG. 5 and the spiking of the spikes becomes shallow.

As a result, the drive power transmitted to the log becomes too small to cut the log. Even if cuttable, the drive power per one spike becomes large, producing a cut crack in a veneer sheet resulting in a poor product.

Figure 6:
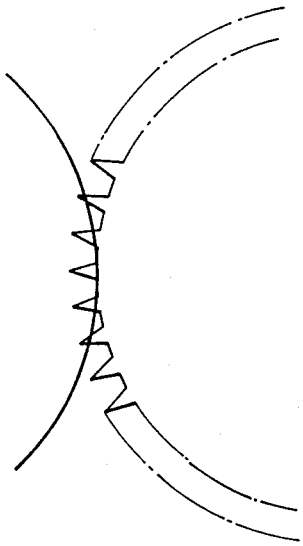

With the constitution of the above-described embodiment, however, the above-mentioned problem can be overcome. Specifically, when the log is large in diameter, the roller A urgedly contacts the log and the urethane rubber 7 is compressed and deformed at its log side (the other side is tensioned and deformed). When the log becomes smaller and the number of the spikes 8 abutting against the log decrease, the reacting force of the log to the roller A becomes smaller. As a result, owing to the function of the deformed urethane rubber 7, the ring shaped member 7 is relatively moved toward the log according to the decreasing reaction force of the log, and the number of the spikes 8 spiked into the log, as shown in FIG. 6, is not largely reduced.

Furthermore, if the roller A is preset in position so as to be able to cut a thin veneer plate, the roller A is not required to change its position according to the thickness of an objective log, because although the log passing through a space between the roller A and knife becomes large in thickness when a thick veneer sheet is cut, the ring shaped member is retreated to the extent that the log became larger in thickness and, as a reaction thereof, the spiking amount of each of the spikes into the outer surface of the log becomes larger corresponding thereto and its power for rotating the log becomes larger.

Figure 3:
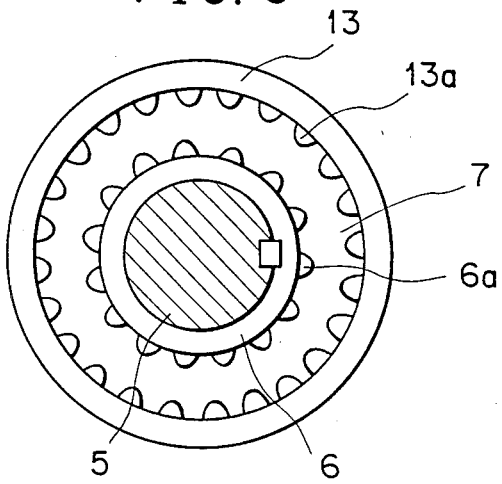
FIG. 3 is a side view showing another embodiment of the invention.

When a veneer sheet having no spiking trace on its surface is required as already referred to, there may be employed a ring shaped member 13 having an even and smooth outer periphery and without having spikes, as shown in FIG. 3, instead of the ring shaped member 9. In this ring shaped member 13, it is true that the drive power to be fed to the log becomes small compared with the case of the above-described embodiment. However, an additional power may be fed to the log from the spindle according to necessity. In this case, in order to keep satisfactory fixing relation between the ring shaped member 13 and the urethane rubber, and between the stationary ring and the urethane rubber, the spikes 13*a* and 6*a* may be also provided to the inner side of the ring shaped member 13 and the outer side of the stationary ring.

A further embodiment will be described next.

Figure 9:
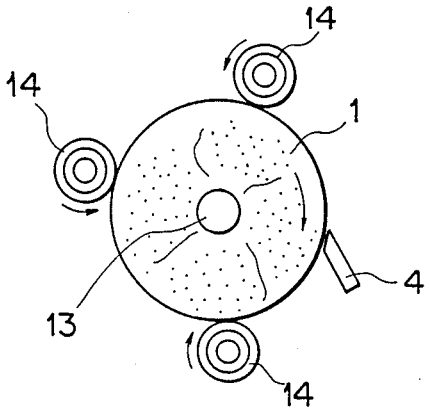
FIG. 9 is a schematic side view of a further embodiment of the present invention.

As is shown in FIG. 9, a veneer lathe includes a spindle 13 for rotatably supporting a log 1 and a knife 4 for cutting the log 1. It also includes three rollers 14 adapted to be urgedly contacted the outer periphery of the log 1 and feed a drive power to the log and a follower mechanism adapted to cause the rollers 14 to continuously contact the outer periphery of the log. The lathe of this embodiment employs the rollers for rotating a log according to the present invention as the rollers 14.

As for such rollers as mentioned above, an integrally formed rigid roller was usually employed. However, the following problem was involved. That is, when a foregoing matter such a cutting chip of a veneer sheet is about to pass through a space between the log and roller, an excessive force occurs between the log and the roller, cracking the log and breaking the roller.

However, if the afore-described roller for rotating a log is used as the roller 14, no excessive force is incurbetween to the log and roller, because each of the rollers has an elastic means and, therefore, when the foreign matter such as a cutting chip of a veneer sheet is about to pass through the space between the log and the roller, a portion of the ring shaped member corresponding to the foreign matter is retreated in the direction far from the log and displaced with respect to the rotatable shaft due to the elastic deformation of the elastic means.

When a roller provided with spikes is also employed in this embodiment, each of the rollers 14 is urgedly contacted the outer periphery of the log 1 and deformed. If a movable member adapted to move toward the center of the log in proportion to the rotation of the log is provided while maintaining the foregoing state, a drive power can be fed to the log due to the provision of the spikes which sufficiently act on the outer periphery of the log even when the log becomes smaller in diameter.

Although three rollers are used in this embodiment, the present invention is applicable to the case in that a log is rotated by two backup rollers as a set or one backup roller.

Furthermore, the above-mentioned roller is not necessarily provided with a drive mechanism. Instead, it may be used as a followable backup roller. Even in this case, there can be overcome the problem involved when the cutting chip of the veneer sheet is about to pass between the space between the log and the roller.

As described in the foregoing, according to the present invention, a plurality of ring shaped members are provided on a rotatable roller through elastic means such as urethane rubber. Accordingly, the power of the elastic means for holding the ring shaped members becomes large. Thus, a log of the kind having a large cutting resistance and a thick veneer sheet can be cut. Moreover, even when a foreign matter enters into a space between a log and a roller for rotating the log, no trouble is occurred. As seen, excellent effects are produced by the present invention.

While certain specific details have been described for the purpose of optimum pressentation of the advantageous features of the present invention, various modifications will be apparent to those skilled in the art without departing from the scope or spirit of the invention.

What is claimed is:

1. A roller assembly of a veneer lathe for rotating a log comprising:

a rotatable means;

elastic means provided on said rotatable means; and a plurality of ring shaped rigid members each having a periphery for press contacting the periphery of a log to rotate the log, said ring shaped rigid members being spacedly provided on said rotatable means with said elastic means interposed therebetween, said ring shaped rigid members being fixed on said elastic means.

2. A roller assembly of a veneer lathe for rotating a log as claimed in claim 1, wherein said rotatable means comprises a rotatable shaft and a stationary ring stationarily mounted on said rotatable shaft.

3. A roller assembly of a veneer lathe for rotating a log as claimed in claim 1, wherein said elastic means is urethane rubber.

4. A roller assembly of a veneer lathe for rotating a log as claimed in claim 1, wherein said elastic means is raw rubber.

5. A roller assembly of a veneer lathe for rotating a log as claimed in claim 1, wherein said elastic means includes a fiber-like material as a reinforcing material.

6. A roller assembly of a veneer lathe for rotating a log as claimed in claim 1, wherein said ring shaped member is formed on substantially its entire periphery with spikes.

7. A roller assembly of a veneer lathe for rotating a log as claimed in claim 1, wherein said ring shaped member has an even and substantially smooth periphery.

8. A veneer lathe including a roller assembly comprising:

rotatable means;

elastic means provided on said rotatable means;

a plurality of ring shaped rigid members each having on its periphery a plurality of spikes and spacedly provided on said rotatable means with said elastic means interposed therebetween, said ring shaped rigid members being fixed on said elastic means, said roller assembly being provided in parallel relation with a log cutting knife at position where said roller assembly contacts a log and a veneer sheet immediately after the veneer sheet was cut out; and a pressure member disposed between adjacent ring shaped members and adapted to press the log slightly ahead of the knife.

9. A roller assembly of a veneer lathe for rotating a log and the like, comprising:

a rotatable shaft;

an elastic member on said rotatable shaft; and at least one generally ring shaped member having an inner periphery secured to an outer surface of the elastic member along substantially the entire inner peripheral extent to transfer cutting resistance to the elastic member along said inner periphery such that diametrically opposed portions of said elastic member on opposite sides of the shaft deform during transfer of said cutting resistance.

10. The roller assembly of claim 9, wherein said ring shaped member is of unitary construction.

11. A veneer lathe including a roller assembly, comprising:

a rotatable shaft;

an elastic member on said rotatable shaft;

at least one generally ring shaped member having an inner periphery secured to an outer surface of the elastic member along substantially the entire inner peripheral extent to transfer cutting resistance to the elastic member along said inner periphery such that diametrically opposed portions of said elastic member on opposite sides of the shaft deform during transfer of said cutting resistance;

a knife mounted to a supporting frame; and a pressure member mounted to the supporting frame and positioned to press the log slightly ahead of the knife.

* * * * *